United States Patent [19]

Kandatsu et al.

[11] Patent Number: 4,880,948

[45] Date of Patent: Nov. 14, 1989

[54] CONTACTOR DEVICE FOR CIRCUIT BREAKER

[75] Inventors: Kiyoshi Kandatsu; Makoto Yamazaki; Hiroshi Kinota, all of Kanagawa, Japan

[73] Assignee: Fuji Electric Co., Ltd., Kanagawa, Japan

[21] Appl. No.: 263,204

[22] Filed: Oct. 27, 1988

[30] Foreign Application Priority Data

Nov. 9, 1987 [JP] Japan ..... 62-282806
Dec. 17, 1987 [JP] Japan ..... 62-319533

[51] Int. Cl.[4] ..... H01H 9/32; H01H 71/16; H01H 33/06

[52] U.S. Cl. ..... 200/151; 335/195; 337/68; 337/91

[58] Field of Search ..... 335/14, 15, 195, 201; 337/68, 91; 200/151, 61.19

[56] References Cited

U.S. PATENT DOCUMENTS 4,458,225 7/1984 Forsell ..... 200/151
4,467,298 8/1984 Belbel et al. ..... 200/151
4,677,266 6/1987 Belbel et al. ..... 200/151

*Primary Examiner*—H. Broome

*Attorney, Agent, or Firm*—Finnegan, Henderson, Farabow, Garrett & Dunner

[57] ABSTRACT

A contactor device for a circuit breaker includes a stationary contactor having a stationary contact, and a stationary conductor secured with the stationary contact and constituting an electricity path extending from an external terminal to the stationary contact, and a movable contactor having a movable contact movable to detachably touch the stationary contact, and a movable conductor secured with the movable contact and constituting an electricity path extending from the movable contact to another external terminal. The contactor device further includes a stationary core made of a ferromagnetic material with a gap between both ends of the stationary core and surrounding the stationary conductor, a movable core provided at a distance from said stationary core to be attracted toward the stationary core by a magnetic flux generated in the stationary core by an excessive overcurrent flowing through the circuit breaker, and an electrically insulating plate movable in a direction perpendicular to that of separation of the movable contact from the stationary contact, so that the insulating plate is moved together with the movable core and inserted into a space between the stationary contact and the movable contact at the time of the attraction of the movable core toward the stationary core, when the breaker cuts off the overcurrent.

10 Claims, 6 Drawing Sheets

CONTACTOR DEVICE FOR CIRCUIT BREAKER

BACKGROUND OF THE INVENTION

1. Field of the Invention

The present invention relates to a contactor device for a circuit breaker, which comprises a stationary contactor composed of a stationary contact and a stationary conductor secured with the stationary contact and constituting an electricity path extending from an external terminal to the stationary contact, and a movable contactor composed of a movable contact movable to detachably touch the stationary contact, and a movable conductor secured with the movable contact and constituting an electricity path extending from the movable contact to another external terminal.

2. Prior Art

FIG. 17 shows the contactor device of a conventional circuit breaker, which includes a stationary conductor 4 shaped as a U-shaped plate and having two mutually parallel portions 4*a* and 4*b*. A stationary contact 5 is secured to the outside surface of the portion 4*a*. A movable contact 6, which is moved into and out of touch with the stationary contact 5, is secured to a movable conductor 7 provided in parallel with the two mutually parallel portions 4*a* and 4*b* of the stationary conductor. The stationary conductor 4 and the stationary contact 5 constitute a stationary contactor. The movable conductor 7 and the movable contact 6 constitute a movable contactor. The stationary contactor and the movable contactor constitute the contactor device of the circuit breaker.

When the circuit breaker with the contactor device thus constituted cuts off a heavy current such as an overcurrent at a relatively high voltage, an arc generated between the stationary contact 5 and the movable contact 6 at the time of the cut-off of the heavy current needs to be quickly driven in between arc extinguishing plates 14*a* in an arc extinguishing chamber 14 and cooled by the arc extinguishing plates to heighten the arc voltage to the voltage of a power supply. For that reason, the relative portions of the contacts 5 and 6 and the arc extinguishing plates 14*a*, the number and dimensions of the plates and so on are determined so that the arc generated between the contacts 5 and 6 is quickly driven in between the plates and cooled by the plates to heighten the arc voltage to the voltage of the power supply while the arc is moved and lengthened in the order of a, b and c as shown in FIG. 18.

However, if the property of recovery of insulation between the stationary contact 5 and the movable contact 6 has only a small margin for the circuit voltage or is insufficient therefor, an arc is generated again between the contacts 5 and 6 at the time of appearance of a recovery voltage therebetween after the current cut-off action of the circuit breaker or the former arc continues to exist without a clear no-current period present before the generation of the latter arc, so that the arc repeatedly takes sequential states shown by a, b and c in FIG. 18. In that case, it is impossible to cut off the current finally. In order to prevent such a phenomenon to surely cut off the current, the gap between the contacts 5 and 6 needs to be enlarged as shown by a one-dot chain line in FIG. 18. As a result, however, the circuit breaker becomes larger and more expensive if it is for a relatively high voltage circuit, resulting in drawback.

SUMMARY OF THE INVENTION

The present invention was made in order to eliminate the above-mentioned drawback with the conventional contactor device.

Accordingly, it is an object of the present invention to provide a contactor device which makes it possible to surely cut off a current at a relatively high voltage, without making a circuit breaker larger and more expensive.

The above-mentioned object is achieved by a provision of a contactor device which includes a stationary contactor composed of a stationary contact and a stationary conductor secured with the stationary contact and constituting an electricity path extending from an external terminal to the stationary contact; a movable contactor composed of a movable contact movable into and out of touch with the stationary contact and a movable conductor secured with the movable contact and constituting an electricity path extending from the movable contact to another external terminal; a stationary core made of a ferromagnetic material, which is formed so as to surround the stationary conductor through a gap between both ends of the stationary core; a movable core provided at a distance from the stationary core near the gap between both ends of the stationary core so as to be attracted toward the stationary core by a magnetic flux generated in the stationary core by an overcurrent flowing through the circuit breaker; and an electrically insulating plate provided to be movable in a direction perpendicular to that of separation of the movable contact from the stationary contact, so that the electrically insulating plate is moved together with the movable core and inserted into the gap between the stationary and the movable contacts at the time of the attraction of the movable core toward the stationary core, when the circuit breaker cuts off the overcurrent.

The present invention is created in view of the experimental result that the property of recovery of insulation after the current cut-off action depends upon the period of time maintaining an arc between the stationary contact and the movable contact in the state of a shown in FIG. 18.

In the contactor device thus constituted according to the present invention, since an arc generated between the stationary and movable contacts is forcibly driven toward an arc extinguishing chamber by the tip portion of the electrically insulating plate, the time throughout which the arc stays between or near both the stationary and movable contacts is much shortened. Since the electrically insulating plate is evaporated by the heat of the arc, the vapor of relatively low temperature retards the rise in the temperature of the contacts to suppress the melting or evaporation thereof. The vapor of relatively low temperature also cools the arc to quickly heighten the voltage across the arc to limit the excessive overcurrent. As a result, the energy of the arc is decreased so that the property of recovery of insulation between both the contacts after the current cut-off action of the circuit breaker is improved. Since the electrically insulating plate covers the whole stationary contact when the distance between the movable and stationary contacts is still minimum, the property of recovery of insulating therebetween is improved further so that the arc does not continue to exist or another arc is not generated again, even if a relatively high transient recovery voltage is applied between both the contacts at the instant of the end of the cut-off of the overcurrent. For that reason, the overcurrent can be always cut off easily, surely and stably without increasing the distance between the stationary and movable contacts at the time of separation thereof, namely, without enlarging the circuit breaker. The size and cost of the circuit breaker can thus be reduced.

DETAILED DESCRIPTION OF THE PREFERRED EMBODIMENTS

The contactor device for the circuit breaker according to the present invention will be described in detail with reference to the drawings attached hereto.

Figure 1:
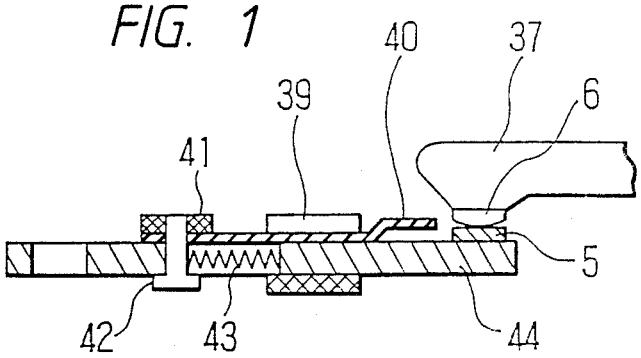
FIG. 1 is a schematic view of a contactor device according to one embodiment of the present invention.
Figure 2:
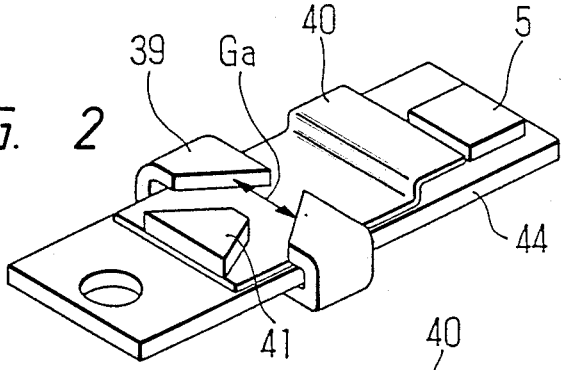
FIG. 2 shows a perspective view of the contactor device in normal use.
Figure 3:
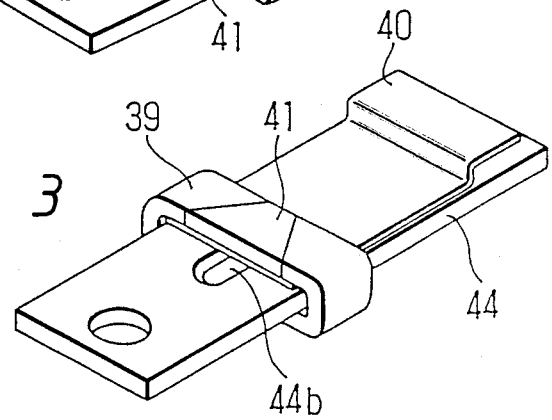
FIG. 3 shows a perspective view of the contactor device under the condition action.
Figure 4:
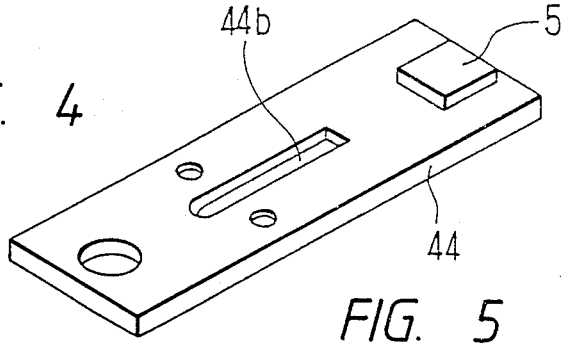
FIG. 4 shows a perspective view of a stationary contactor included in the contactor device.
Figure 5:
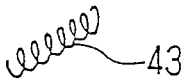
FIG. 5 shows a perspective view of a spring included in the contactor device to keep the movable core thereof in a non-operative position.
Figure 6:
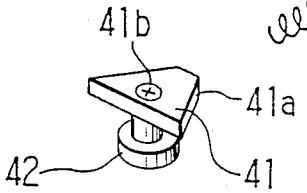
FIG. 6 shows a perspective view of the movable core provided with a stepped pin.
Figure 7:
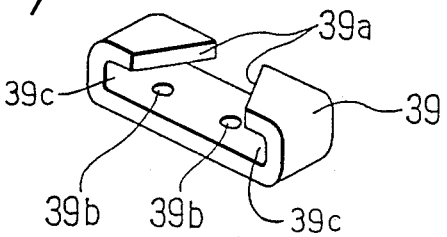
FIG. 7 shows a perspective view of a stationary core included in the contactor device.
Figure 8:
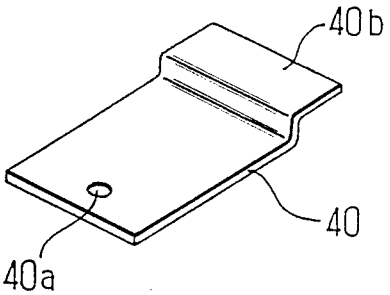
FIG. 8 shows a perspective view of the electrically insulating plate.
Figure 9:
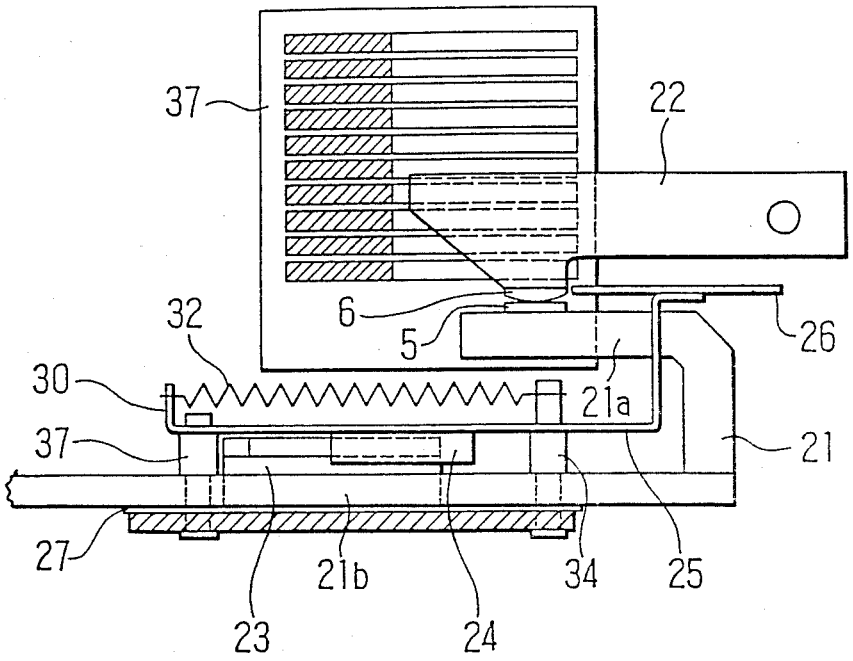
FIG. 9 shows a schematic view of a contactor device according to another embodiment of the present invention.

FIGS. 1 through 8 show a contactor device according to one embodiment of the present invention. The contactor device includes a stationary conductor 44 shaped as a strip. A stationary core 39 is formed so as to surround the stationary conductor 44 through a trapezoidal gap Ga between both ends of the stationary core 39, as shown in FIG. 2. The stationary core 39 extends in a direction perpendicular to the longitudinal direction of the stationary conductor 44 so as to hold both sides of the stationary conductor 44 and is provided with a pair of grooves **39*c* opposite to each other to be coupled to the bottom of the stationary conductor 44 in a magnetically and mechanically rigid manner. An electrically insulating plate 40, which is inserted into the gap between a stationary contact 5 and a movable contact 6 when the movable contact 6 is detached (separated) from the stationary contact 5, is inserted into the opening between the stationary conductor 44 and the grooves 39*c* of the stationary core 39 in the direction of the thickness thereof to be movable along one surface of the stationary conductor 44. The electrically insulating plate 40 is coupled to a plate-like trapezoidal movable core 41 by a stepped pin 42, which is movable while being guided by a slot 44*b* penetrating the stationary conductor 44 in the direction of the thickness thereof and extending in the longitudinal direction thereof as shown in FIGS. 3 and 4. When an overcurrent flows through the stationary conductor 44 so that the movable core 41 is attracted toward the stationary core 39 by a magnetic flux generated in the stationary core, the electrically insulating plate 40 coupled to the movable core 41 by the stepped pin 42 is moved toward the stationary contact 5 as the initial direction of the movement of the electrically insulating plate 40 toward the stationary contact is kept by the inner surfaces of the opposite grooves 39*c* of the stationary core 39, so that the electrically insulating plate 40 is surely inserted into the gap between the stationary contact 5 and the movable contact 6 and closely covers the whole stationary contact. As a result, an arc generated between both the contacts 5 and 6 is forcibly driven toward an arc extinguishing chamber by the tip portion of the electrically insulating plate 40, and the electrically insulating plate made of an arc extinguishing dielectric material such as an aromatic polyester is partly evaporated by the heat of the arc to cool the stationary contact 5 and the arc around the stationary contact 5 to quickly heighten the arc voltage and to limit the excessive overcurrent thereby to decrease the energy of the arc. The property of recovery of insulation between both the contacts 5 and 6** after the current cutoff action of the contactor device is thus made high.

Figure 10:
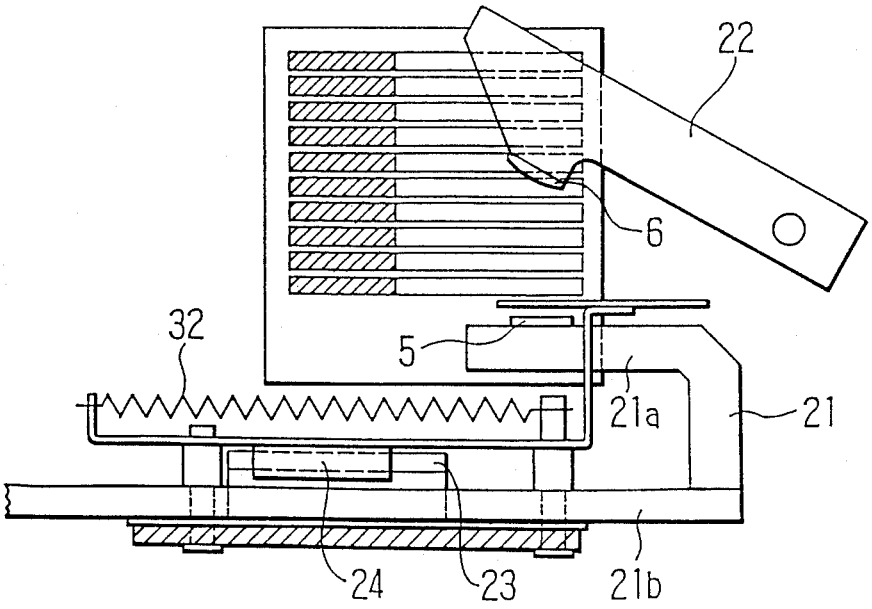
FIG. 10 shows a schematic view indicating the state of cut-off action of the contactor device shown in FIG. 9.
Figure 11:
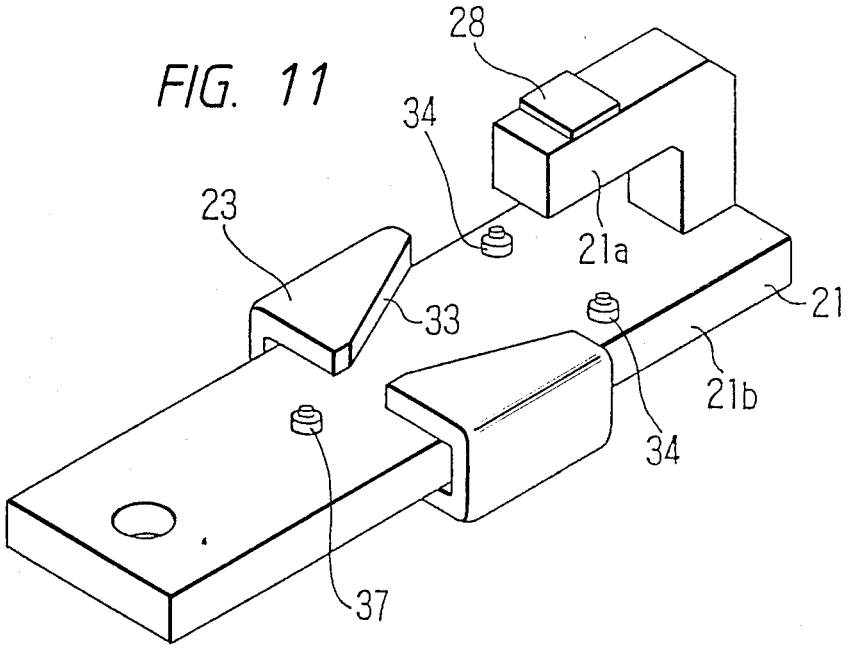
FIG. 11 shows a perspective view of the stationary section of the contactor device shown in FIG. 9.
Figure 12:
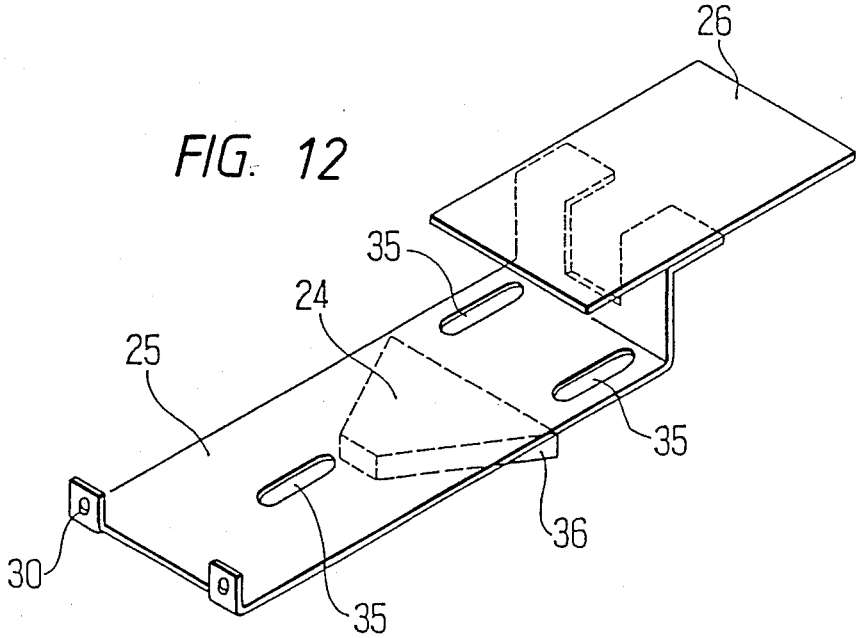
FIG. 12 shows a perspective view of the movable section of the contactor device shown in FIG. 9.
Figure 13:
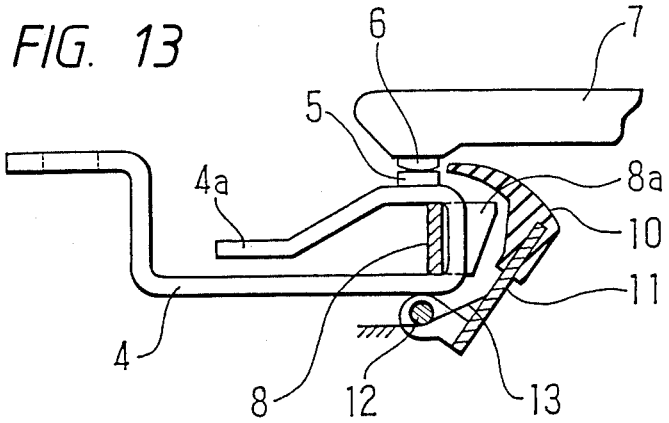
FIG. 13 shows a schematic view of a contactor device according to a further embodiment of the present invention.

FIGS. 9 through 12 show a contactor device according to another embodiment of the present invention. The contactor device includes a stationary conductor 21 of a U-shape. As shown in FIG. 11, a pair of pins 34 and a pin 37 different in height from each other are planted in a lower portion **21*b* of the stationary conductor 21. The small-diameter portions of the pins 34 and 37 are fitted in slots 35 provided in a thin movable plate 25 made of nonmagnetic metal, as shown in FIG. 12. A helical tension spring 32 is extended between the pair of pins 34 and a pair of engaging lugs 30 provided on one end portion of the movable plate 25 so that the movable plate 25 is normally kept in a position shown in FIG. 9. As shown in FIG. 11, the lower portion 21*b* of the stationary conductor 21 is closely surrounded by a stationary core 23 with a trapezoidal gap widening in the longitudinal direction of the stationary conductor 21. As shown in FIG. 12, a trapezoidal movable core 24 having a pair of oblique sides 36 parallel with those of the trapezoidal gap between both ends of the stationary core 23 is secured to the bottom of the movable plate 25, and an electrically insulating plate 26 is secured to the right-hand (as to FIG. 12) end portion of the movable plate 25 by means of adhesive or the like. When an overcurrent flows through a circuit breaker so that a tripping mechanism (not shown) can act to move a movable contact 6 to be detached from a stationary contact 5, a movable conductor 22 secured with the movable contact 6 receives a strong electromagnetic repulsive force because the upper portion 21***a* of the stationary conductor 21 constitutes an electricity path in the reverse direction to the movable conductor 22, so that the movable contact 6 is quickly moved to be detached from the stationary contact 5 as shown in FIG. 10. At the same time, a magnetic flux is generated in the stationary core 23 and the trapezoidal movable core 24 by the overcurrent flowing through the lower portion 21*b* of the stationary conductor 21, to apply an attractive force to the movable core 24 to move it together with the movable plate 25 leftward (as to FIG. 10) against the forces of the springs 32 to insert the electrically insulating plate 26 into the gap between the stationary contact 5 and the movable contact 6. The property of recovery of insulation between both the contacts 5 and 6 after the current cut-off action of the contactor device is thus made high.

Figure 14:
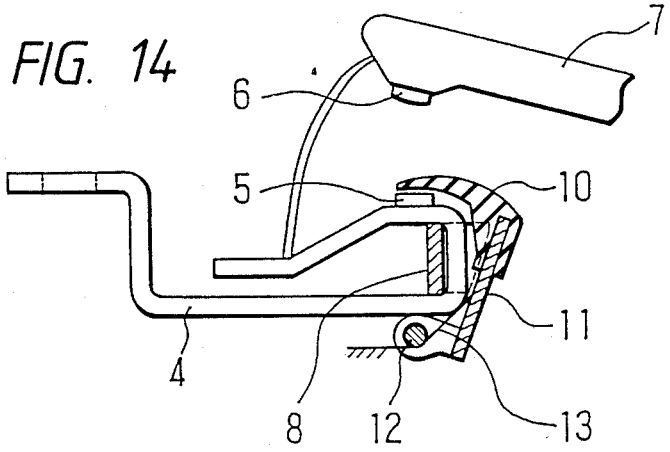
FIG. 14 shows a schematic view indicating the state of cut-off action of the contactor device shown in FIG. 13.
Figure 15:
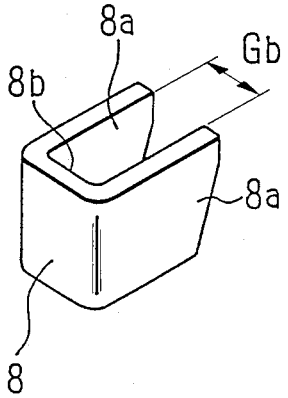
FIG. 15 shows a perspective view of the stationary core of the contactor device shown in FIG. 13.
Figure 16:
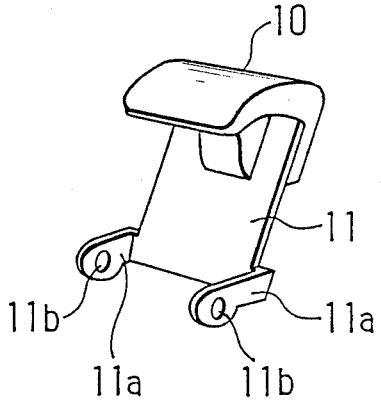
FIG. 16 a perspective view of the movable core and the electrically insulating plate of the contactor device shown in FIG. 13.
Figure 17:
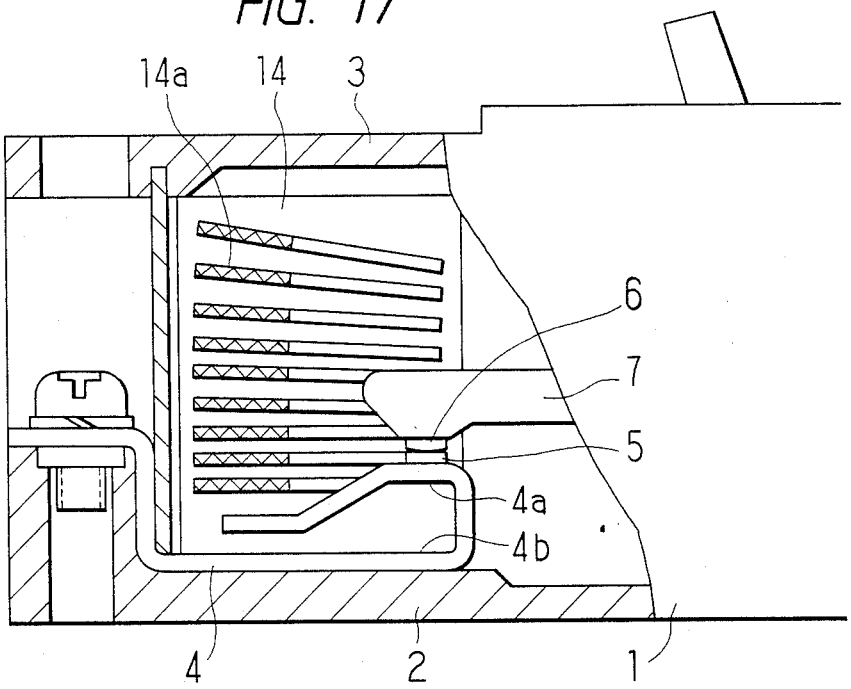
FIG. 17 shows a partially sectional view of the contactor device of a conventional circuit breaker.
Figure 18:
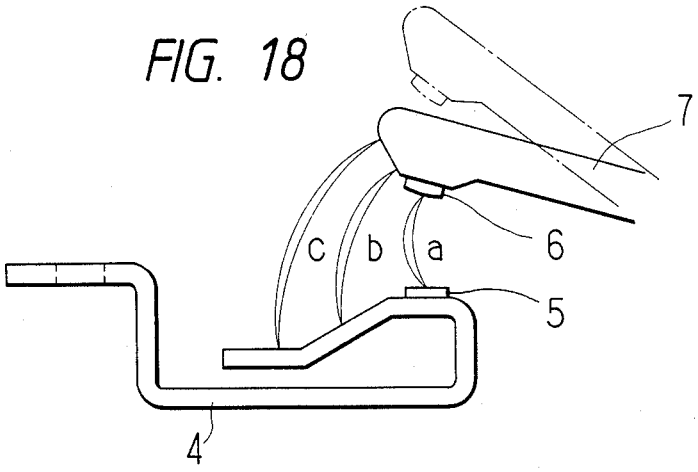
FIG. 18 a view indicating the state of cut-off action of the contactor device of the conventional circuit breaker.

FIGS. 13 through 16 show a contactor device according to a further embodiment of the present invention. A U-shaped stationary core 8 has a gap Gb provided between both ends thereof as shown in FIG. 15, and surrounds the U-shaped stationary conductor 4. The stationary core 8 is U-shaped so that both sides of the stationary conductor 4 are put between a pair of mutually parallel sides 8*a* of the stationary core 8. The inside surface 8*b* of the base of the U-shaped stationary core 8 is opposed to the inside surface of the U-shaped stationary conductor 4, that is, to the inside surface of the base of the stationary conductor 4. The movable core 11 is formed of a flat plate so that it is attracted toward both ends of the U-shaped stationary core 8. An electrically insulating plate 10 made of an arc extinguishing dielectric material such as an aromatic polyester is secured to the tip portion of the movable core 11 by adhesive or the like. The movable core 11 is pivotally supported by a shaft 12 provided immediately under a stationary contact 5, so that the movable core 11 is kept in a non-operative position by a spring 13 in the normal application of the electrical current.

When a heavy current such as an overcurrent flows through a circuit breaker including the contactor device, the movable contact 6 of the contactor device is moved to be detached from the stationary contact 5 by a tripping mechanism (not shown), so that a gap is made between both the contacts 5 and 6, as shown in FIG. 14. At the same time, a magnetic flux is generated in the stationary core 8 and the movable core 11 by the current flowing through the stationary conductor 4, to attract the movable core 11 toward the stationary core 8 to short-circuit the air gaps of the magnetic circuit at both ends of the U-shaped stationary core 8. Since the electrically insulating plate 10 secured to the movable core 11 is in the form of a circular arc with the center of the shaft 12, the insulating plate 10 closely covers the whole stationary contact 5 as the insulating plate 10 is inserted into the gap between the stationary contact 5 and the movable contact 6 as a result of the attraction of the movable core 11 to the stationary core 8. The property of recovery of insulation between both contacts 5 and 6 after the current cut-off action of the contact device is thus made high.

As described above, the contactor device according to the present invention is arranged so that the electrically insulating plate is inserted into a gap between the stationary contact and the movable contact at the time of breaking of an overcurrent. As a result, an arc generated between the stationary and movable contacts is forcibly driven toward the arc extinguishing chamber by the tip portion of the electrically insulating plate so that the present invention has the following advantages.

The time when the arc stays between or in the vicinity of the stationary and movable contacts is remarkably reduced. Since the arc around the stationary and movable contacts is cooled by the evaporation of the electrically insulating plate due to the heat of the arc, the voltage across the arc is quickly heightened to limit the overcurrent. As a result, the energy of the arc is decreased so that the property of recovery of insulation between both the stationary and movable contacts after the current cut-off action is improved. Since the electrically insulating plate covers the whole stationary contact when the distance between the stationary and movable contacts is still minimum, the property of recovery of insulation therebetween is further improved so that the arc does not continue to exist or another arc is not generated again, even if a relatively high transient recovery voltage is applied between both the contacts at the instant of the end of the cut-off of the overcurrent. For that reason, the excessive overcurrent can be always cut off easily, surely and stably without increasing the distance between the stationary and movable contacts at the time of separation thereof, namely, without enlarging the circuit breaker.

What is claimed is:

1. A contactor device for a circuit breaker having a pair of external terminals, comprising:

a stationary conductor having a central axis and a surface and a stationary contact mounted on said surface, constituting an electricity path extending from one of the external terminals to said stationary contact;

a movable conductor including a movable contact movable to detachably touch said stationary contact, and constituting an electricity path extending from said movable contact to another of the external terminals;

a stationary ferromagnetic core; fixedly mounted on said stationary conductor with opposing pole portions spaced from each other in a direction transverse the central axis;

an insulative member, coaxially mounted on the stationary conductor, movable between a normal position and an overcurrent position relative the stationary contact, having a portion disposed to substantially cover said stationary contact at times when the insulative member is in the overcurrent position, and spaced away from said stationary contact at times when the insulative member is in the normal position; and a movable ferromagnetic core fixedly mounted on and movable with the insulative member disposed in a first location spaced from the opposing pole portions at times when the insulative member is in the normal position and a second location adjacent the opposing pole portions at times when the insulative member is in the overcurrent position;

wherein a magnetic flux in said stationary core attracts said movable core to said second location at times when an overcurrent flows in said stationary conductor thereby moving said insulative member to said overcurrent position.

2. A contactor device as claimed in claim 1, wherein said stationary conductor is strip-shaped, said stationary core has a pair of grooves opposite each other to be coupled to the surface of said stationary conductor in a magnetically and mechanically rigid member, said insulative member is coupled to said movable core and movably provided on said stationary conductor at the side of said gap thereof along a slot coaxially penetrating said stationary conductor and extending in the longitudinal direction thereof, and the direction of the movement of said movable core is kept constant by said grooves of said stationary core.

3. A contactor device as claimed in claim 1, wherein said opposing pole portions of said stationary core define a trapezoid widening toward a side opposite to said stationary contact, and said movable core is of a trapezoidal configuration having oblique sides parallel with those of said opposing pole portions.

4. A contactor device as claimed in claim 1, wherein said stationary conductor is U-shaped having a first end thereof connected to one of the external terminals, and a second end thereof to which the stationary contact is secured, said stationary core being provided on said stationary conductor at the first end engaging both sides of said stationary conductor and provided with a pair of grooves opposite to each other to be coupled to the outside surface of said stationary conductor in a magnetically and mechanically rigid manner, a movable plate is secured to said movable core, which is moved along a slot coaxially penetrating said stationary conductor and extending in the longitudinal direction thereof, so that said movable plate is moved coaxially with said stationary conductor, and said insulative member is provided on the end of said movable plate at the side of said stationary contact.

5. A contactor device as claimed in claim 4, wherein said opposing pole portions of the stationary core define a trapezoid convergent or divergent toward the stationary contact, and the movable core is of a trapezoid configuration with oblique sides parallel to the opposing pole portions.

6. A contactor device as claimed in claim 1, wherein said stationary conductor is U-shaped with a first end thereof connected to one of the external terminals and a second end thereof to which said stationary contact is secured, said stationary core is U-shaped having parallel side portions wherein both sides of said stationary conductor are located between the two side portions of said stationary core, and said movable core is configured flat and pivotally coupled to a shaft parallel with said stationary core, and wherein said movable core is attracted to the side portion of said stationary core, and said insulative member is secured to an end of said movable core opposite said shaft.

7. A contactor device as claimed in claim 1, 2, 3, 4, 5 or 6, wherein said movable core further includes means fixedly mounted in said slot for urging said movable core toward said first location at times when no overcurrent is flowing in said stationary conductor.

8. A contactor device for a circuit breaker, comprising:

a stationary contactor including a stationary contact, and a stationary conductor secured with said stationary contact and constituting an electricity path extending from an external terminal to said stationary contact;

a movable contact including a movable contact movable to detachably touch said movable contact and constituting an electricity path extending from said movable contact to another external terminal;

a stationary core made of a ferromagnetic material, which is formed so as to surround said stationary conductor through a gap between both ends thereof;

a movable core provided at a distance from said stationary core in the vicinity of said gap so as to be attracted toward said stationary core by a magnetic flux generated in said stationary core by an overcurrent flowing through said circuit breaker; and an electrically insulating plate movable in a direction transverse to that of separation of said movable contact from said stationary contact, said electrically insulating plate being moved together with said movable core and inserted into an open space between said stationary contact and said movable contact at the time of the attraction of said movable core toward said stationary core, when said breaker cuts off said overcurrent;

wherein said stationary conductor is strip-shaped, said stationary core is formed so as to hold both sides of said stationary conductor, and provided with a pair both sides of grooves opposite to each other to be coupled to one surface of said stationary conductor in a magnetically and mechanically rigid manner, said electrically insulating plate is coupled to said movable core, which is movably provided on said stationary conductor at the side of said gap thereof along a slot penetrating said stationary conductor in the direction of the thickness thereof and extending in the longitudinal direction thereof, and the direction of the movement of said movable core is kept constant by said grooves of said stationary core.

9. A contactor device for a circuit breaker, comprising:

a stationary contactor including a stationary contact, and a stationary conductor secured with said stationary contact and constituting an electricity path extending from an external terminal to said stationary contact;

a movable contactor including a movable contact movable to detachably touch said stationary contact, and a movable conductor secured with said movable contact and constituting an electricity path extending from said movable contact to another external terminal;

a stationary core made of a ferromagnetic material, which is formed so as to surround said stationary conductor through a gap between both ends thereof;

a movable core provided at a distance from said stationary core in the vicinity of said gap so as to be attracted toward said stationary core by a magnetic flux generated in said stationary core by an overcurrent flowing through said circuit breaker; and an electrically insulating plate movable in a direction transverse to that of separation of said movable contact from said stationary contact, said electrically insulating plate being moved together with said movable core and inserted into an open space between said stationary contact and said movable contact at the time of the attraction of said movable core toward said stationary core, when said breaker cuts off said overcurrent;

wherein said stationary conductor is constituted by a U-shaped plate having one end thereof, which is connected to the external terminal, and the other end thereof, to which the stationary contact is secured, said stationary core is provided on said stationary conductor at the side of the external terminal thereof, so as to hold both sides of said stationary conductor and provided with a pair of grooves opposite to each to be coupled to the outside surface of said stationary conductor in a magnetically and mechanically rigid manner, a movable plate is secured to said movable core, which is moved along a slot penetrating said stationary conductor in the direction of the thickness thereof and extending in the longitudinal direction thereof, so that said movable plate is moved in parallel with the longitudinal direction of said stationary conductor, and said electrically insulating plate is provided on the end of said movable plate at the side of said stationary contact.

10. A contactor device as claimed in claim 9, wherein said gap between both ends of the stationary core is shaped as a trapezoid convergent or divergent toward the stationary contact, and the movable core is shaped as a trapezoidal plate whose oblique sides are parallel with those of said gap.

* * * * *

UNITED STATES PATENT AND TRADEMARK OFFICE

CERTIFICATE OF CORRECTION

PATENT NO. : 4,880,948

DATED : November 14, 1989

INVENTOR(S) : Kiyoshi Kandatsu et al.

It is certified that error appears in the above-identified patent and that said Letters Patent is hereby corrected as shown below:

Claim 8, column 7, and line 65 change "contact" (1st occurrence) to --contactor--.

Signed and Sealed this

First Day of December, 1992

*Attest:*

DOUGLAS B. COMER

*Attesting Officer*

*Acting Commissioner of Patents and Trademarks*